United States Patent [19]

Benson

[11] Patent Number: 4,691,268

[45] Date of Patent: Sep. 1, 1987

[54] CAST RESIN LIGHT-EMITTING DISPLAY DEVICE

[76] Inventor: Walter L. Benson, 17237 7th St. E., Sonoma, Calif. 95476

[21] Appl. No.: 789,505

[22] Filed: Oct. 21, 1985

[51] Int. Cl.[4] ..... F21S 3/00

[52] U.S. Cl. ..... 362/223; 362/260; 362/812

[58] Field of Search ..... 362/217, 223, 224, 812, 362/260

[56] References Cited

U.S. PATENT DOCUMENTS

| | | | |
|---|---|---|---|
| 2,356,654 | 8/1944 | Cullman | 362/223 |
| 2,595,771 | 5/1952 | Curzon | 362/223 |
| 2,631,225 | 3/1953 | Gadomski | 362/224 |
| 4,262,327 | 4/1981 | Kovacik et al. | 362/223 |
| 4,521,835 | 6/1985 | Meggs et al. | 362/217 |

*Primary Examiner*—E. Rollins Cross

*Attorney, Agent, or Firm*—Thomas M. Freiburger

[57] ABSTRACT

A decorative illuminated article for producing a deep glow in darkness includes an elongated body of thick-walled cast plastic resin with an inner tubular channel extending longitudinally throughout the length of the cast body. Within the tubular channel is positioned a neon or similar light source. The plastic resin includes a pigment which will produce, in combination with the color of the inner light source, a deep glowing color effect when the article is illuminated in darkness. A method for producing the decorative article is also disclosed.

17 Claims, 6 Drawing Figures

CAST RESIN LIGHT-EMITTING DISPLAY DEVICE

BACKGROUND OF THE INVENTION

The invention relates to illuminated display devices, and more particularly to a decorative elongated article illuminated by an inner neon or similar light source, for producing a deep and striking glow in darkness. The invention also encompasses a method for producing such an article, in cast plastic resin.

Numerous illuminated signs and display articles with various degrees of artistic content have been known and used. Much display art has been created using neon (or similar light source gases) as a source of illumination.

No previous illuminated display article known to the applicant, however, has produced a visual effect similar to that of the present invention described below. Further, it has not been known to produce an illuminated decorative display article in a manner similar to the method according to the invention, also described below.

SUMMARY OF THE INVENTION

In accordance with the present invention, a decorative display article is produced so as to generate an unusual visual effect, particularly in darkness. A body of thick-walled cast plastic resin material is illuminated from within, by a neon (or similar) light source, producing a deep and somewhat mysterious glow at night, and also an interesting visual effect when illuminated in daytime. The color emitted by the display article is controlled by the color of the neon light source within the cast body, as well as by the color of the cast body itself. In daytime, although the glow is still clearly visible, the article tends to take on more the color of the cast body, while in darkness, the emitted color is influenced to a greater extent by the color of the light source within.

In accordance with the invention, the wall thickness of the cast plastic resin body, in all directions outwardly from the light source toward the viewer, is at least one-half inch in thickness, and preferably at least about one inch in thickness.

In the method of the invention, a plastic casting resin such as polyester resin is poured into an elongated mold having an elongated tubular member positioned in the mold to produce an inner tubular chase or channel substantially throughout the length of the resulting cast body. The tubular channel will receive a neon light tube, or a light source of a similar gas which will emit light when an electric current is passed through it. Neon and other inert gases are usually used. In this regard, it should be understood that the term "neon" as used herein and in the claims is intended to encompass any such suitable light-source gas.

In the method of the invention, the plastic casting resin is poured into the open-topped mold at about 62° to 65° F., with the mold contained within a temperature-maintaining bath for maintaining such temperature until the casting resin becomes tacky. A curing agent is carefully added and mixed into the resin immediately prior to pouring, along with a coloring pigment.

When the resin has become tacky, i.e., it has partially set and become rigid to the touch although still not completely cured, the temperature of the bath, and of the resin, is raised to about 115° F. and maintained there for a further annealing period until the resin becomes substantially fully cured, which may be about 10 hours. In this way, the resin can generally be cured in a shorter period of time than otherwise would be required, and it has been found that this curing method is adequate to relieve curing stresses, particularly for a polyester resin.

At the end of the period of higher-temperature curing, the resulting molded article is removed from the mold, with the elongated tubular chase coursing through the article for receipt of the neon light tube.

The tubular member may comprise, for example, polycarbonate platic tubing of about $\frac{7}{8}$ inch outside diameter, which can remain in the cast body.

The method of the invention produces a thick-walled cast plastic resin body having a tubular chase for receipt of a "neon" illumination source, of the character desired to produce the effects described above. The cast decorative article may be formed in eight-foot lengths, assembled or ganged together as desired in a composite illuminated display.

It is therefore among the objects of the invention to provide a method and a resulting article which will produce a unique and striking visual effect by day, and particularly by night, emitting deep glow of color emanating from the neon source and radiating through the thick body of cast resin. These and other objects, advantages, features and characteristics of the invention will be apparent from the following description of a preferred embodiment, considered along with the accompanying drawings.

DECRIPTION OF THE DRAWINGS

DESCRIPTION OF A PREFERRED EMBODIMENT

Figure 1:
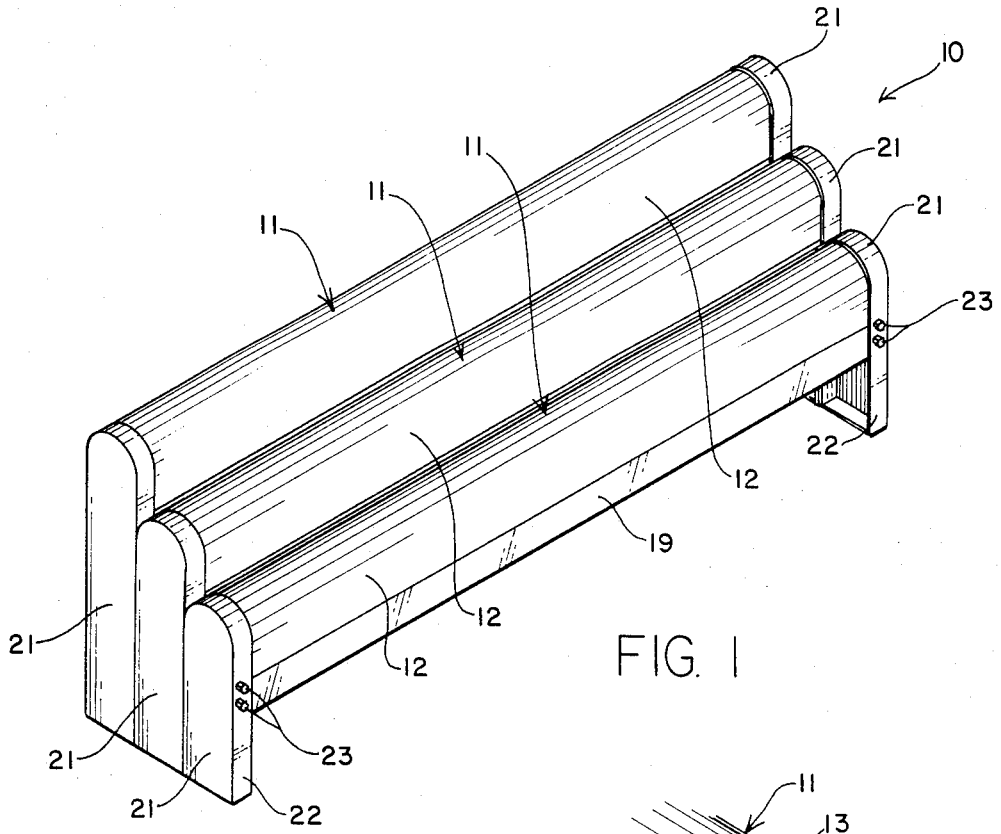
FIG. 1 is a perspective view illustrating several illuminated articles in accordance with the invention, in a decorative display.

In the drawings, FIG. 1 shows a display generally indicated by the reference number 10 and comprising a series of decorative internally illuminated articles 11. The illuminated display articles 11 are elongated in shape, and a principal feature of each is that it comprises a body 12 of thick-walled cast light-transmissive plastic resin, pigmented with a desired color to produce, in cooperation with a neon or similar light tube 13 inside the body 12, a unique and deep glowing effect, particularly in darkness.

Figure 2:
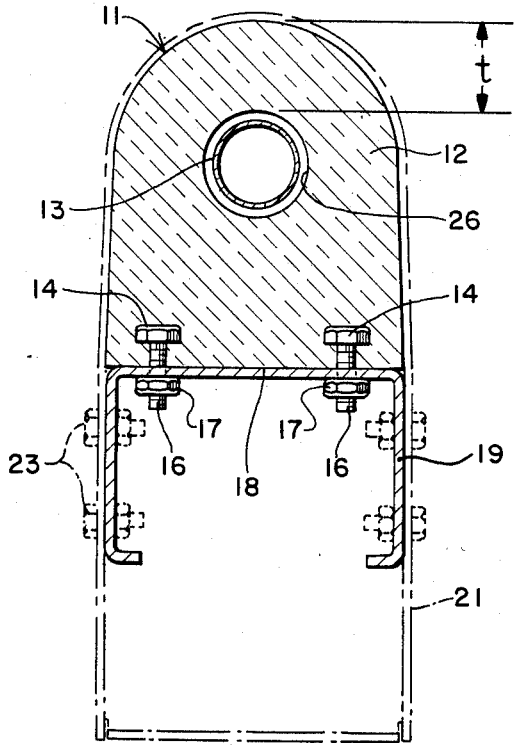
FIG. 2 is a sectional view through a display article of the invention, illustrating internal construction.

As indicated in the sectional view of FIG. 2, the cast resin body 12 preferably has captured into the resin a plurality of bolts 14 or threaded studs, with threaded ends 16 extending out of the resin body for receipt of nuts (or other appropriate fasteners) 17, to connect a flat surface 18 (which may be called a bottom or a back surface) to a decorative structural support beam 19. As illustrated in FIG. 2, the support beam 19 may be generally a channel-shaped member, for securing to the cast body 12 in the orientation shown, but it may comprise any suitable structural support member, such as an I-beam, box beam, etc. The beams may comprise, for example, stainless steel structural channel members, chrome plated steel members, or anodized aluminum members. The openings in the beam 19 for receipt of the bolts preferably are slotted, to allow for expansion/contraction, and elastomeric grommets (not shown) may be used. If ¼ inch bolts 14 are used, for example, the slots may be about ¾ inch long.

As FIG. 2 illustrates, the sides of the cast resin body 12 which are to be viewed have thick walls with a thickness t. The thickness t should be a minimum of about one-half inch to produce the desired glowing effect, and more preferably the thickness is in the range of about one inch to 1½ inch.

FIG. 1 illustrates that each of the elongated illuminated display articles 11 may have a decorative end covering 21 which is shaped to fit over both the end of the cast body 12 and the end of the support beam 19. A flange 22 extends over the cast body and a part of the beam 19, and it provides a structural member which may be connected, as by bolts 23, to the support beam 19. The position of the cover 21 and of the connector bolts 23 is indicated in broken lines in FIG. 2. As also shown in FIGS. 1, 2 and 3, the end covers 21 may be taller than the height (or depth, depending upon orientation) of the resin body 12 and the support beam 19, and these covers may be in various heights, to position the illuminated display articles 11 at different levels or in different planes.

Figure 3:
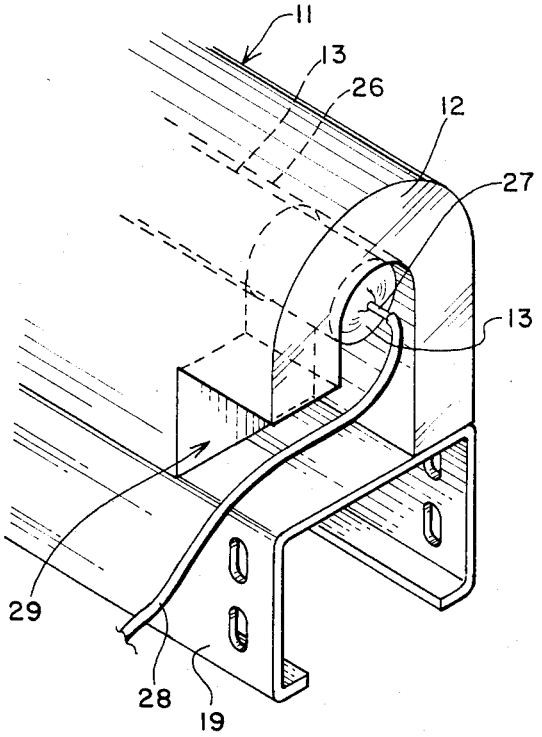
FIG. 3 is a view in perspective, showing a preferred construction at the ends of the display article of the invention, shown with an end covering removed.

In FIG. 3 the end of an illuminated display article 11 is illustrated with the end cover removed. The "neon" light tube 13 is shown positioned within the tubular chase 26 of the cast resin body 12, with an electrical lead 27 extending out through the glass light tube and being connected to a power supply lead 28, there being an opposing lead at the other end of each tube. A boot 30 of rubber or similar material may be included to guide and protect the lead 28 through an exit hole in the channel member 19, as shown. As indicated, there may be a recess or cutout portion 29 at one side of the end of the cast resin body, for accommodating the wiring and providing access when units 11 are arranged end-to-end.

Figure 4:
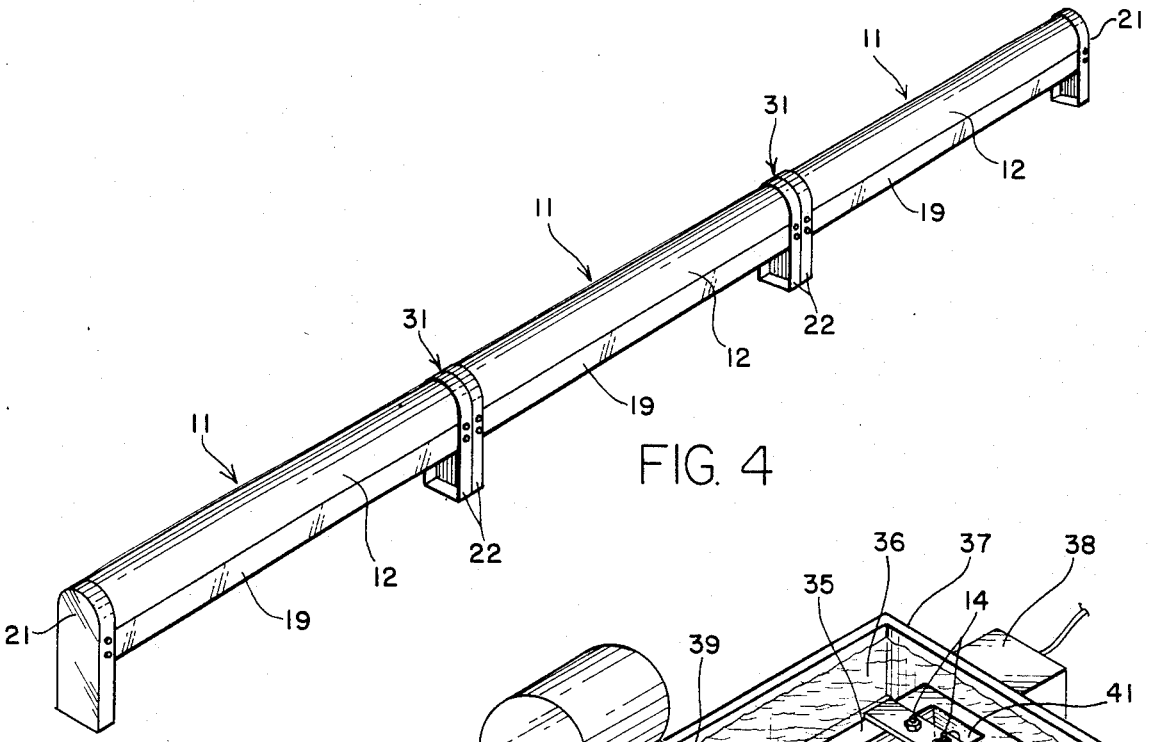
FIG. 4 is a view showing another decorative arrangement of display articles of the invention.

FIG. 4 shows several illuminated display articles or units 11 arranged end-to-end for use in an elongated linear light display. Any number of such units 11 may be ganged together, not only lengthwise but also side-by-side, provided sufficient transformers are included for the number of light tubes used. In the serial lengthwise arrangement as shown in FIG. 4, there may be provided end-to-end connector units 31, similar to the end covers 21 but having flanges 22 extending in both directions, i.e., to overlap both the adjacent ends of the cast bodies 12 and support beams 19. In this way, successive units in a serial arrangement may be secured together and supported appropriately, with a minimum of components.

Figure 5:
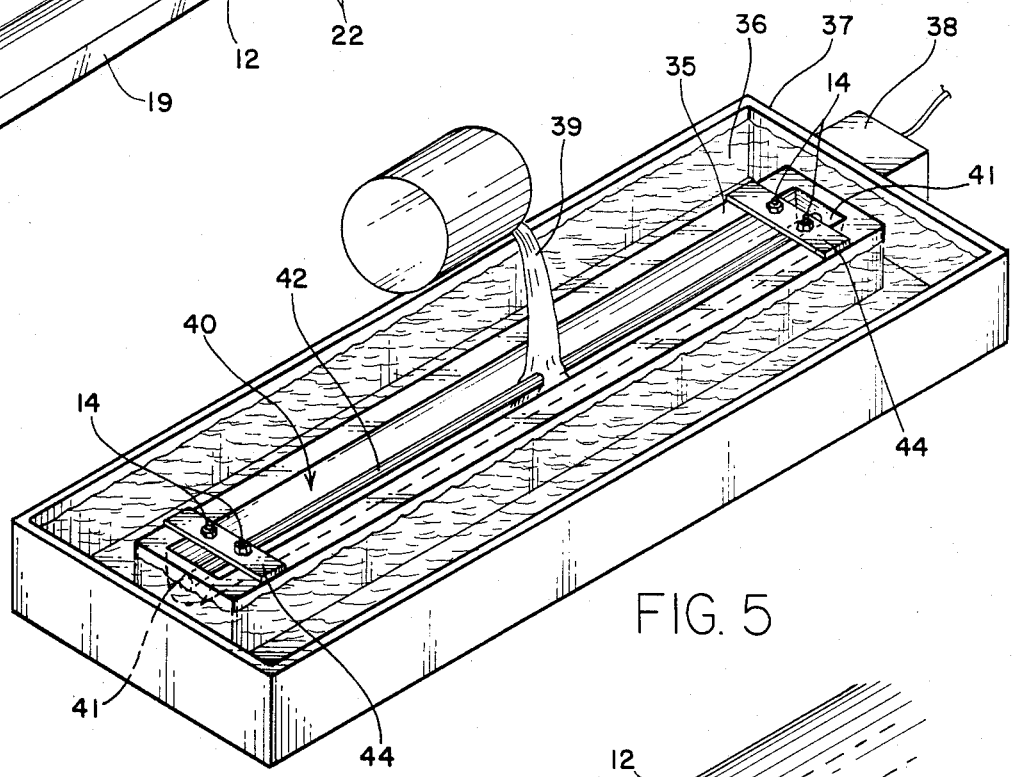
FIG. 5 is a schematic perspective view indicating the method of molding an article in accordance with the invention, with an open-topped mold lying in a temperature-maintaining bath, and with liquid plastic casting resin containing a curing agent and a coloring pigment being poured into the mold.
Figure 6:
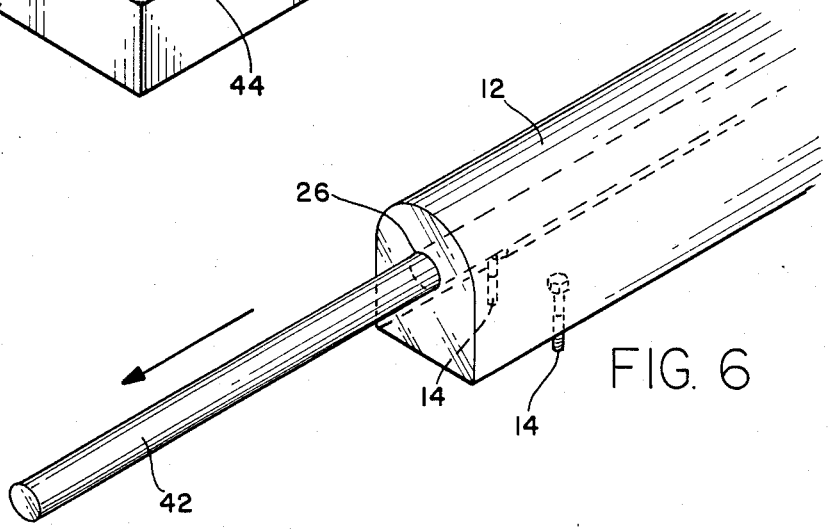
FIG. 6 is a further view illustrating the molded product after removal from the mold, and indicating studs extending from a flat side of the molded body. The tubular internal member provides a chase for receipt of a "neon" light tube.

FIGS. 5 and 6 illustrate the method of the invention. In FIG. 5, there is shown an open-topped mold 35 lying in a temperature-controlled bath 36, which may comprise water in an open container 37, controlled in temperature by a temperature control unit 38.

The temperature of the bath 36 preferably is maintained in a range of about 62° to 65° F., while resin (such as a polyester casting resin) 39 is poured into the mold cavity 40. Just prior to pouring of the resin 39, a curing agent is added and throughly mixed into the resin. The resin also contains a desired pigment, which may be a deep pigment of a primary color, although other colors will also produce a striking effect in the finished article.

Retained within the mold cavity 40, as indicated in FIG. 5, is a tubular device 42 for forming a tubular chase in the molded body. This should be a relatively rigid tubular member such that it will not sag or float appreciably in an elongated mold cavity, such as eight feet long. It may be held at the ends of the cavity 41 by any appropriate means, such as brackets placed in the ends of the mold for this purpose.

Preferably, the tubular member is a hollow sheath of clear polycarbonate plastic, which can remain in the casting permanently. Flotation in the liquid resin can be prevented by insertion of a rigid member (such as a steel rod) into the sheath for casting, to be removed later. The tubular member may be about ¾ inch inside diameter, but this will vary with the size of the "neon" tube to be put in the chase.

FIG. 5 also shows that the bolts or studs 14 which are to extend from the bottom side of the cast body may be supported as by a flat supporting strip 44 resting on the mold, with clips or nuts holding the bolts 14 from dropping into the resin. The opposite ends of the bolts 14 will be captured into the resin as indicated in FIG. 2, when the resin becomes set up and cured. Normally, pairs of these bolts or studs will be at about three foot spacing down the length of the cast article. They may be located, for example, about six to eight inches from the ends and slightly inward from the sides, with three pairs used on an eight-foot cast product.

The studs 14 not only provide for latter connection of the cast body to the structural support, but also provide a means for removal of the cast body from the mold after curing.

The casting resin 39, having been poured into the open-topped mold 35 approximately to the top of the mold (or to a desired level), preferably is maintained at the 62° to 65° F. temperature range until the resin becomes tacky. Then the temperature of the setting resin is raised to a higher temperature of about 115° F., by raising the temperature of the cooling bath 36.

The higher temperature is maintained in an annealing step, until the molded plastic resin becomes substantially fully cured and hard. This may be a period of about 10 hours. It is a function of the plastic resin used and the quantity of curing agent used, as well as of temperature. The temperatures and procedures described herein have been found to relieve curing (shrinkage) stresses as well as providing for a relatively short and effective cure time.

Next, the resulting cast resin body 12 is removed from the mold, as shown in FIG. 6, and any rigidifying member (not shown) inside the tubular sheath is removed. This leaves the desired longitudinal tubular chase or channel 26 extending through the length of the resin body through the sheath 42 (see also FIG. 2).

As indicated, the bolt supporting members 44 have been removed from the resin body 12, and the bolts or studs 14 extend downwardly from the plastic body 12.

A neon light tube is then inserted into the tubular space or chase 26, to extend substantially the full length of the plastic resin body 12. Prior to this step the recess 29 may be made at the end of the body 12 (see FIG. 3), if desired for accommodating electrical wiring. This may be removed by cutting, or it may be molded into the body, by placing an appropriate spacer in the open-topped mold cavity 41 (not shown in FIG. 5).

The "neon" light tube is of a desired source color which, in combination with the pigmentation in the resin, will produce the desired colors, both by day and by night.

The mold for the cast resin body may be of various shapes and sizes, not limited to the configuration shown in the drawings. Also, the position and the diameter of the "neon" light tube in the cast resin body may vary, depending to some extent on the shape of cross-section used for the resin body. A principal requirement is that the walls of the body be relatively thick (from the light tube to the visible exterior), as discussed above.

After the illuminated display article 11 has been constructed, the neon tube within the resin body may still be changed, to change the source color emitting through the resin body. This creates a color change in overall effect.

The display articles of the invention produce a striking color glow in darkness. They also produce an unusual effect in daylight. The intensity of pigment in the cast resin and the preferably different color of the "neon" tube create changing overall light effects as sunlight or darkness changes. The brighter the exterior light, the more predominant is the pigment color of the polyester resin. The darker the exterior, the more predominant the color of the "neon" tube within the polyester shape becomes.

The preferred embodiment described herein is intended to illustrate the principles of the invention, but not to be limiting of its scope. Various other embodiments will be apparent to those skilled in the art and may be made without departing from the spirit and scope of the invention as defined in the following claims.

I claim:

1. A light-emitting display device capable of emitting a deep colorful glow in darkness, comprising:

a thick-walled elongated body of cast light-transmissive plastic resin having an elongated longitudinal tubular chase within the body, a pigment in the resin, a neon light tube within the internal tubular chase, as a source of light of the display device, end closure means on the ends of the elongated body, and means for illuminating the neon light tube.

2. The display device of claim 1, wherein the plastic resin comprises a polyester casting resin.

3. The display device of claim 1, wherein the cast body is an approximately 8-foot modular segment for arrangemnet with other similar segments to form a display.

4. The display device of claim 1, wherein the thick-walled body has walls, on sides oriented for display, of at least about one-half inch thickness from the tubular chase to the exterior.

5. The display device of claim 4, wherein said walls are about one inch to 1½ inch in thickness.

6. The display device of claim 1, further including an elongated structural support beam secured to a back side of the elongated cast body.

7. The display device of claim 6, wherein the structural support beam comprises a stainless steel structural channel.

8. The display device of claim 7, wherein the end closure means comprise stainless steel end members configured to be positioned against the ends of the cast plastic resin body and of the structural channels, and means for securing the end members to the structural channels.

9. The display device of claim 1, wherein the tubular chase comprises a hollow tubular sheath encapsulated within the molded body, extending end-to-end.

10. The display device of claim 1, wherein the neon light tube emits a light color which is different from the color of the plastic resin, so that the overall color of the display device changes between daylight and darkness.

11. A method for making a light-emitting display device capable of emitting deep colorful flow in darkness, comprising:

providing an elongated open-topped mold in a liquid temperature-maintaining bath, placing in the mold an elongated tubular device substantially teh full length of the mold, in position to form a longitudinal tubular space surrounded by thick walls, pouring a polyester casting resin into the mold at about 62° to 65° F., the resin including a coloring pigment and a curing agent, maintaining the bath at about 62° to 65° F., until the casting resin becomes tacky, then raising the temperature of the setting resin to a higher temperature of about 115° F., by raising the temperature of the bath, maintaining the higher temperature in an annealing step, until the molded plastic becomes substantially fully cured and hard, removing the resulting case resin body from the mold, and placing a neon light tube inside the tubular space formed by the tubular device, substantially through the length of the resin body, whereby, when the neon tube is powered to emit light, a deep glow emanates through the thick walls of the resin body, colored by the color of the resin body and the color emitted by the light tube.

12. The method of claim 11, wherein the tubular device comprises a hollow tube of polycarbonate plastic.

13. The method of claim 11, wherein the coloring pigment is red.

14. The method of claim 11, wherein the coloring pigment is dark blue.

15. The method of claim 11, wherein said higher temperature is maintained for about 10 hours.

16. The method of claim 11, further including positioning a plurality of threaded studs partially in the mold so as to be captured into the resin and to extend outwardly therefrom, for providing a connection means for connecting the cast body to a support, and including using the studs for gripping the cast resin body to remove it from the mold after curing.

17. The method of claim 11, further including selecting the neon light tube to be of a different color from that of the plastic resin body, so that the color effect presented by the display device changes with daylight and darkness.

* * * * *